US005654544A

United States Patent [19]

Dresch

[11] Patent Number: 5,654,544

[45] Date of Patent: Aug. 5, 1997

[54] MASS RESOLUTION BY ANGULAR ALIGNMENT OF THE ION DETECTOR CONVERSION SURFACE IN TIME-OF-FLIGHT MASS SPECTROMETERS WITH ELECTROSTATIC STEERING DEFLECTORS

[75] Inventor: Thomas Dresch, Berlin, Germany

[73] Assignee: Analytica of Branford, Branford, Conn.

[21] Appl. No.: 694,878

[22] Filed: Aug. 9, 1996

[51] Int. Cl.[6] ..... H01J 49/00

[52] U.S. Cl. ..... 250/287; 250/283; 250/286

[58] Field of Search ..... 250/287, 286, 250/283, 281, 282, 397

[56] References Cited

U.S. PATENT DOCUMENTS

| | | | |
|---|---|---|---|
| 2,642,535 | 6/1953 | Schroeder | 250/287 |
| 2,938,116 | 5/1960 | Benson et al. | 250/287 |
| 4,517,462 | 5/1985 | Boyer et al. | 250/286 |

*Primary Examiner*—Jack I. Berman
*Assistant Examiner*—Kiet T. Nguyen
*Attorney, Agent, or Firm*—Levisohn, Lerner, Berger & Langsam

[57] ABSTRACT

Electrostatic deflectors are used in a time of flight mass spectrometer to steer ions into a detector positioned at a convenient location at the end of a drift region and where the detector assembly is tilted in relation with the steered ion beam in a manner which improves mass spectral resolution.

13 Claims, 6 Drawing Sheets

A

B

MASS RESOLUTION BY ANGULAR ALIGNMENT OF THE ION DETECTOR CONVERSION SURFACE IN TIME-OF-FLIGHT MASS SPECTROMETERS WITH ELECTROSTATIC STEERING DEFLECTORS

RELATED APPLICATIONS

This application claims the benefit of of U.S. Provisional Application No. 60/002,121, filed Aug. 10, 1995.

FIELD OF THE INVENTION

The invention relates to Time-of-Flight Mass Spectrometers (TOF-MS) and more particularly to the use of electrostatic deflectors in such mass spectrometers with homogeneous electric fields in the flight tube in order to steer the ions that are analyzed in a desired direction. According to the invention, the mass resolution of such a TOF-MS can be enhanced if the detector surface is aligned with a specific angle.

BACKGROUND OF THE INVENTION

Time-of-Flight Mass Spectrometers (TOF-MS) are devices used to analyze ions with respect to their ratio of mass and charge. In a typical linear TOF-MS, as it is described e.g. in U.S. Pat. No. 2,685,035 and Wiley et at., ions are accelerated in vacuum by means of electrical potentials which are applied to a set of parallel, substantially planar electrodes, which have openings that may be covered by fine meshes to assure homogeneous electrical fields, while allowing the transmission of the ions. The direction of the instrument axis shall be defined as the direction normal to the flat surface of these electrodes. Following the acceleration by the electrical fields between said accelerator electrodes, the ions drift through a field free space or flight tube until they reach the essentially flat surface of an ion detector, further referred to as a detector surface, where their arrival is converted in a way to generate electrical signals, which can be recorded by an electronic timing device. An example of such a detector is a multi channel electron multiplier plate (MCP). The measured flight time of any given ion through the instrument is related to the ion's mass to charge ratio.

In another typical arrangement (See e.g., U.S. Pat. No. 4,072,862, Soviet Union Patent No. 198,034, and Karataev et al., Mamyrin et at.), the motion of the ions is turned around after a first field free drift space by means of an ion reflector. In such a Reflector-TOF-MS the ions reach the detector after passing through a second field free drift space. The properties of such ion reflectors allow one to increase the total flight time, while maintaining a narrow distribution of arrival times for ions of a given mass to charge ratio. Thus, mass resolution is enhanced over that of a linear instrument.

It is common practice to use electrostatic deflectors with homogeneous fields in TOF-MS in order to steer the ions towards the detector. In one particular case, this is done in order to offset a common perpendicular component of motion of the ions prior to the acceleration. In another case, deflectors are employed in order to establish a V shaped configuration of accelerator, reflector and detector in a Reflector-TOF-MS. Traditionally, the steering action required has been small and its impact on the mass resolution of the instrument has been neglected (Karataev et al., Mamyrin et at.).

Recently, however, new atmospheric pressure ionization techniques, which are especially well suited for the ionization of complex biomolecules, have renewed the interest in the orthogonal injection of eternally generated ions into the accelerator of a TOF-MS. This method was originally described by O'Halloran et at.; recent implementations are found in Dawson et at., Dodonov et at., Verentchikov.

In this particular application of TOF-MS, the injected ions can have substantial kinetic energy and, hence, a substantial velocity component perpendicular to the flight tube axis. The result of this velocity component is an unwanted oblique drift of the ions in the flight tube of the mass analyzer. It follows that a relatively strong steering action is required to redirect the ions towards the instrument axis and the detector. It was found experimentally that such steering causes distortions in the distribution orion flight times which can considerably diminish the mass resolution of the instrument.

The present invention recognizes the physical reasons for distortions created by the steering of the ions, and corrects these distortions by mechanically adjusting the detector surface at a calculated angle that enhances the mass resolution of the instrument.

OBJECTS AND BRIEF DESCRIPTION OF THE INVENTION

It is an object of the invention to provide means that can compensate for the reduction in performance that occur in TOF-MS due to electrostatic steering of the ions in the flight path.

Ions accelerated inside a vacuum chamber from between two parallel lenses ideally form a thin sheet of ions of a given ratio of mass to charge moving in a common direction at a constant velocity down the flight tube. This constant velocity corresponds to an initial common accelerating electrical potential, whereafter the accelerated ions pass through apertures, shielding tubes or other electrodes held at a constant electrical potential. At any given point in time in the flight path, the positions of these ions form an isochronous surface in space. At first, this isochronous surface shall be perpendicular to the direction of motion of said ions.

In one embodiment of the invention, two parallel flat plate electrodes of a given dimension are arranged such that these ions enter the space between these plates in a direction which is essentially parallel to the surface of the plates. If an electrical potential difference is applied to the plate electrodes, preferentially in such a way that one plate is held at a potential +V/2, and the other at a potential −V/2 with respect to the other electrodes or shielding tubes preceding the plates, then the direction of motion of said ions is deflected by a certain angle. It is taught by the invention that a further result of the deflecting electric field between the plate electrodes is a tilt in space of the isochronous surface formed by the ions.

If, as in, for example, a linear TOF-MS the ions of a single mass ion package shall be detected essentially simultaneously by an ion detector, then, according to the invention, it is required that the detector surface be tilted with respect to a plane which is thought parallel to the original isochronous surface of said ions.

In order to achieve the optimum performance it is furthermore required, according to the invention, that the tilting of the detector surface must be accomplished in such a way that the tilt angle lies in the plane of deflection and is equal to the angle of deflection but in the opposite sense of rotation.

Further aspects and implications of the invention as well as its advantages in several preferred embodiments will become clear from the following detailed description.

a) ions entering parallel to the axis and leaving under an angle $\alpha$.

b) ions entering under an angle $\alpha$ and leaving parallel to the axis.

Figure 4:
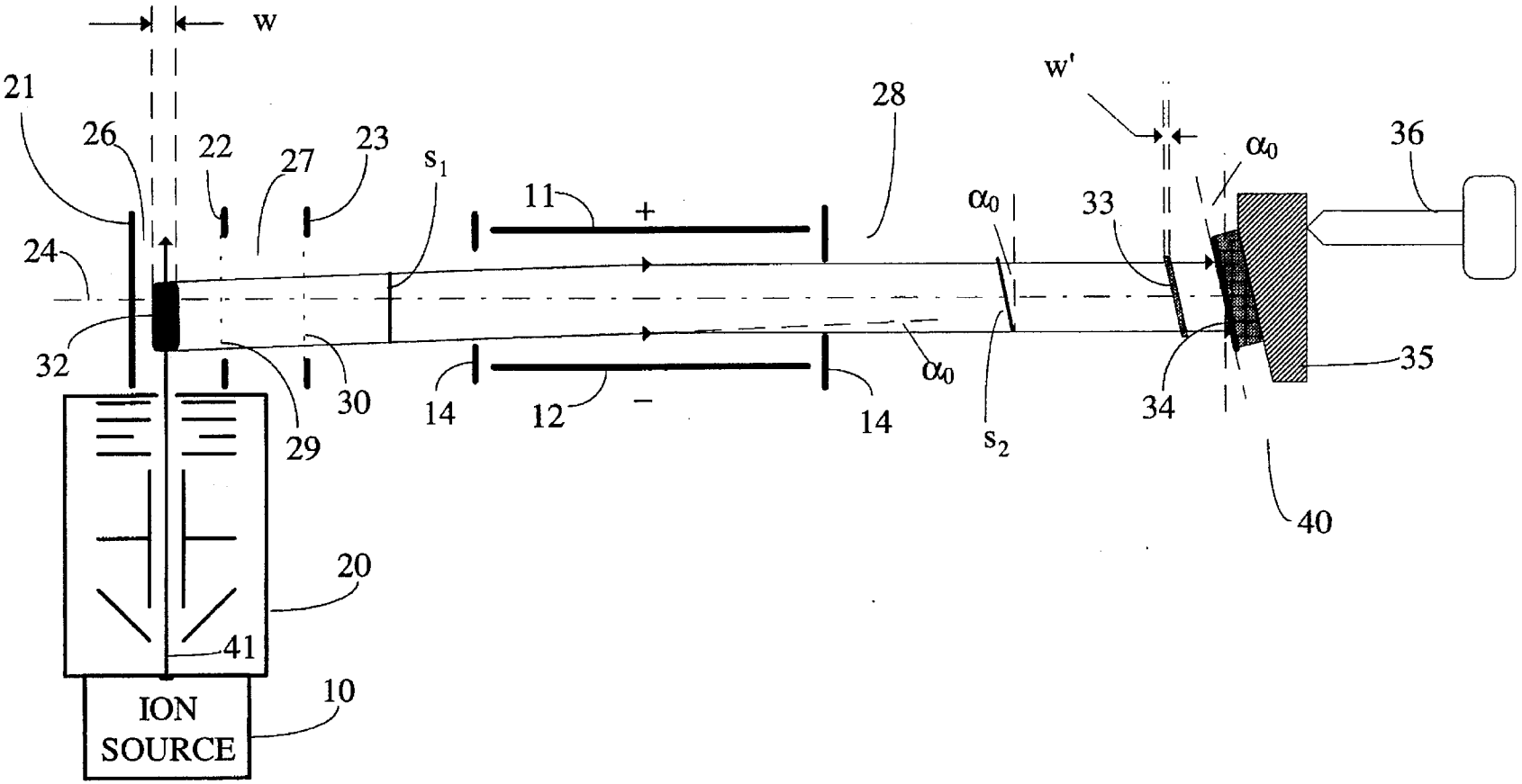

FIG. 4 is the schematic representation of the linear time of right mass spectrometer with orthogonal injection of externally generated ions, electrostatic deflector and tilted detector conversion surface.

Figure 5:
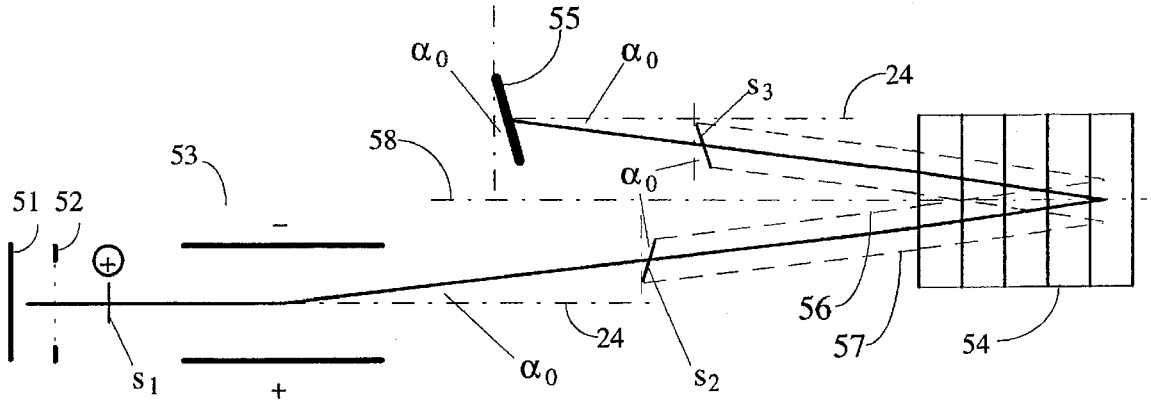

FIG. 5 is the schematic representation of a Reflector TOF with parallel reflector and accelerator electrodes and fields.

Figure 6:
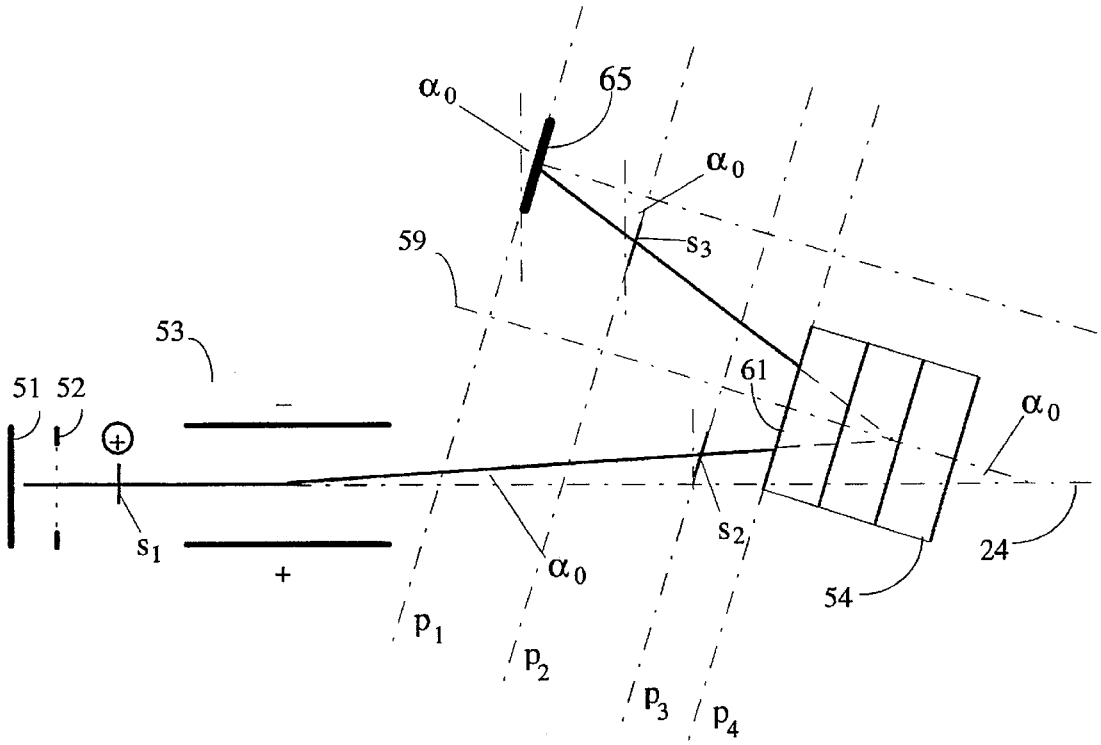

FIG. 6 is the schematic representation of a Reflector-TOF MS with inclined reflector.

Figure 7:
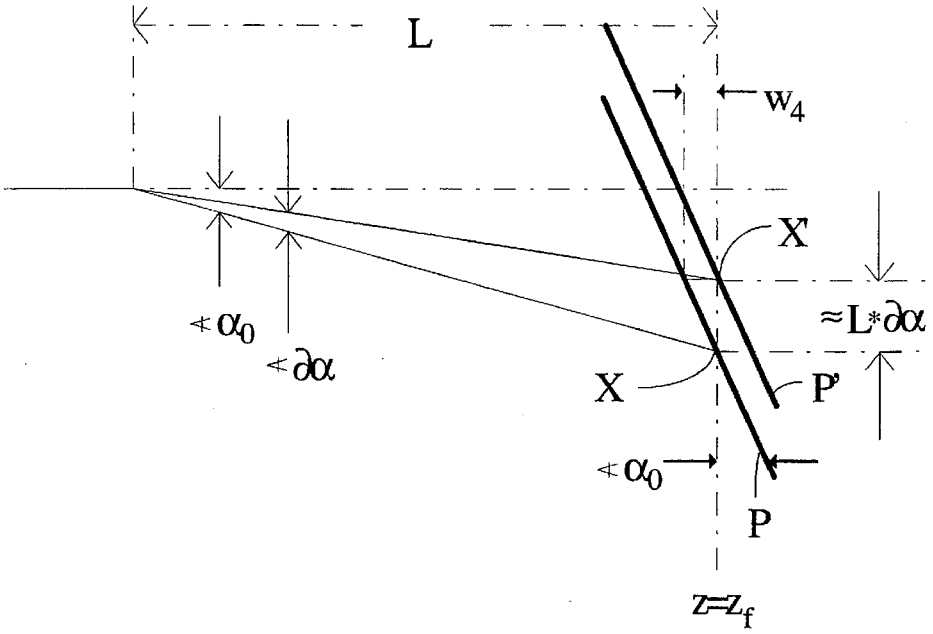

FIG. 7 shows the broadening $w_4$ of an ion package focused in time at the plane $z=z_f$ due to a distribution of axial kinetic energies.

Figure 8:
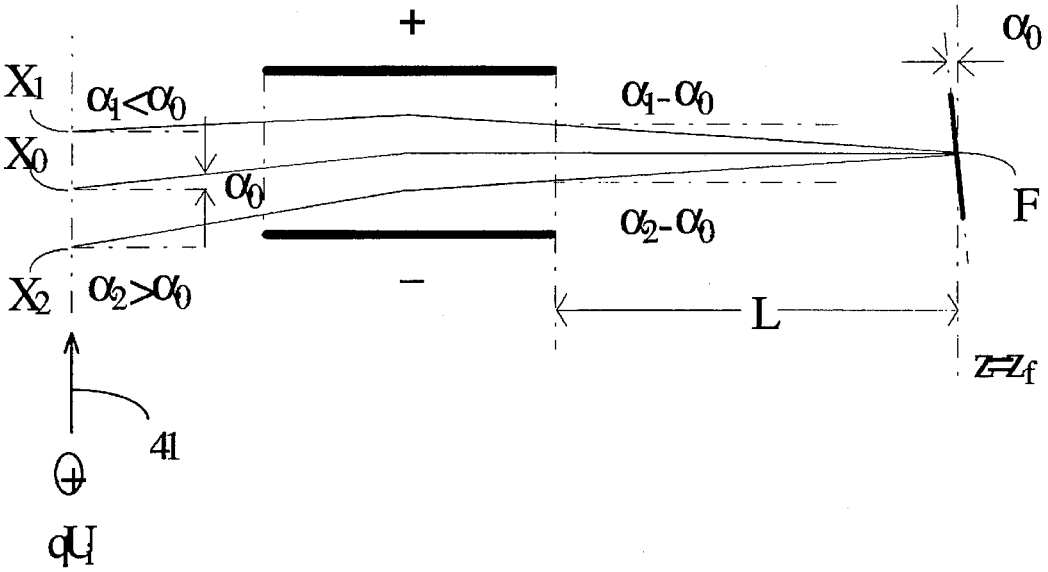

FIG. 8 shows the valuation of the distribution of arrival times induced by a spread in the orthogonal injection energy.

DETAILED DESCRIPTION OF THE INVENTION AND THE PREFERRED EMBODIMENTS

The Electrostatic Deflector

Figure 1A:
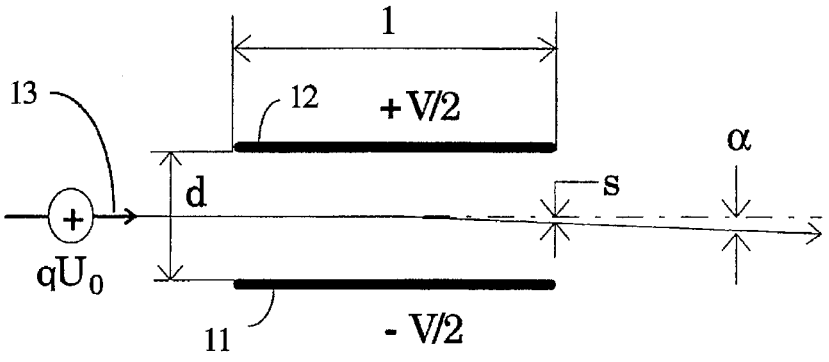
FIG. 1A and FIG. 1B shows a pair of typical electrostatic deflector plates with ideal instantaneous onset of the homogeneous field; the coordinate system follows the central trajectory; the central trajectory (x=0) and two (positive) ion trajectories passing the isochronous plane $t=t_0$ at distances $x=+\Delta$ and $x=-\Delta$ from the centerline are shown.

Electrostatic deflectors with a homogeneous electrical field which is oriented perpendicular to the axis of a charged particle beam are used to steer or deflect this beam of ions or electrons into a desired direction. The ions deflection trajectories are independent of the particles mass to charge ratio and depend only on electric potentials. This feature makes it especially suitable for TOF-MS in that all ions can be accelerated and deflected by the same electric potential difference. In the embodiment that is shown in FIG. 1A, electrostatic deflectors consist of two parallel plate electrodes 11 and 12 spaced an equal distance apart with the beam of charged particles 13 entering at the symmetry plane between the deflector plates. One plate is held at a positive electrical potential while the other is held at a negative electrical potential with respect to the last electrode, aperture or shielding tube 14 that was passed by the ion beam prior to entering the deflector. This reference potential will be referred to as the beam potential. The electric field between the plates accelerates the charged particles perpendicular to the direction of the incoming beam 13 and therefore changes the direction of the beam.

Properties of the Electrostatic Deflector

In order to evaluate the electrostatic deflector, let l be the length of the plates and d the distance between them as it is defined in FIG. 1*a;* the applied deflection voltage V is split symmetrically with respect to the beam potential for the sake of simplicity. Then, in the symmetry plane between the plates 11 and 12 of a deflector, the potential inside the deflector is equal to the beam potential; the trajectory of ions 13 that enter the deflector in said symmetry plane is the reference trajectory. Ions enter the deflecting field with kinetic energy $qU_0$, where q is the ion's electrical charge, and $U_0$ the total ion acceleration electric potential difference.

If the dimensions of the plates are such that both length and width are sufficiently larger than the separation of the plates and if the beam dimensions are small compared to both, then the effects of the fringing fields at the ends of the plates are of minor concern as the ions spend much more time in the homogeneous field between the plates than in the inhomogeneous fields near the entry and exit of the deflector. It is known from Herzog that with special apertures close to the ends of the deflector plates the electric field in a close approximation acts as an ideal deflection field with instantaneous onset of a homogeneous perpendicular field at an effective field boundary which is determined only by the geometry of apertures and deflector plates.

Figure 1B:
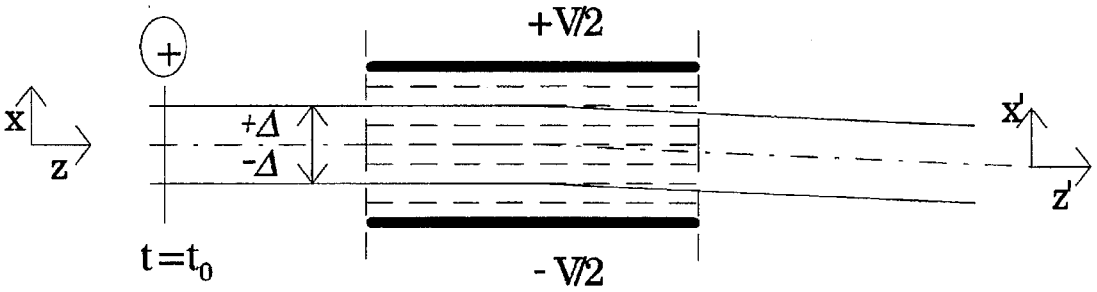

Now let the length of the equivalent deflection field between the effective field boundaries be equal to the length l as it is indicated in FIG. 1*b*. For such an ideal deflector it can be readily shown that the angle of deflection of an ion entering at x is given by Equation (1). Only small angles are to be considered and the approximation $\phi\approx\tan\phi\approx\sin\phi$ is valid and will be used for all the angles (angles are in units of radians);

$$\alpha(x)=\alpha_0\cdot\left[1-\frac{Vx}{U_0d}-\alpha_0^2\right]^{-1/2} \tag{1a}$$

or equivalently;

$$\alpha(x)=\alpha_0\cdot\left[1+\frac{1}{2}\cdot\frac{Vx}{U_0d}+\frac{1}{2}\alpha_0^2+\ldots\right] \tag{1b}$$

$\alpha_0$ is the first order angle of deflection of the reference trajectory (x=0):

$$\alpha_0=\frac{1}{2d}\cdot\frac{V}{U_0} \tag{2}$$

From Equations (1) and (2) it is evident that the angle of deflection is independent of charge q and mass m of the particles. Here, only small angles of deflection are to be considered and quantities of higher order in $\alpha_0$ are very small. Under the presuppositions made above, the quantity $Vx/U_0d<<1$ is also a small quantity and the approximation $\alpha(x)\approx\alpha_0$ is justified in many applications.

Residence Time Inside the Deflector

Ions moving above or below the reference trajectory are decelerated (or accelerated) by entering the deflecting field; accordingly, they spend more (or less) time in the deflecting field than the central reference trajectory of the beam. This difference in residence times is of primary interest for TOF-MS.

To quantify this difference, two coordinate system (x,y,z) and (x',y',z') are introduced in FIG. 1*b;* the z-axis of the unprimed coordinate system lies in the symmetry plane between the plates, the x-axis is perpendicular to the deflector plates 11 and 12. The axis of the primed system are parallel to the unprimed ones, but the origin of the primed coordinate system moves with the reference trajectory. The in-going and out-going beams define the x-z plane as the plane of deflection. Ion trajectories start at a time $t=t_0$ in the x-y plane and move in direction of the z-axis towards the deflector. At any given time $t>t_0$ the package of ions forms an isochronous surface, given by the location of all the particles on their respective trajectories at that time.

Positive ions entering the ideal deflecting field are accelerated (x<0) or decelerated (x>0) instantaneously in z-direction (for negative ions signs have to be inverted but the contents of the equations is left unchanged). The kinetic energy in the z-direction inside the deflecting field is a function of the entry coordinate x and given by the relation:

$$qU_z(x)|_{inside} = q\cdot\left(U_0 - \frac{V}{d}\cdot x\right) \tag{3}$$

The reference trajectory with x=0 is not shifted in energy or time compared to the undeflected beam inside the deflector. The difference $\tau$ in residence time with respect to the reference trajectory is given by:

$$\begin{aligned}\tau &= \tau(x) = T_R(x) - T_R(0) = \frac{l}{v_z(x)} - \frac{l}{v_z(0)} \\ &= l\cdot\sqrt{\frac{m}{2q}}\cdot\left(\frac{1}{\sqrt{U_z(x)}} - \frac{1}{\sqrt{U_0}}\right) \\ &= l\cdot\sqrt{\frac{m}{2qU_0}}\cdot\left(\frac{1}{\sqrt{1-\frac{V\cdot x}{U_0\cdot d}}} - 1\right)\end{aligned} \tag{4}$$

Here, $qU_z$, and $v_z$ are the ion kinetic energy and velocity in the z-direction inside the deflector, $T_R(x)$ is the residence time as a function of the entry coordinate x. $Vx/U_0d$ is small compared to 1 and to first order, $\tau_1$, the residence time difference, is given as a function of entry coordinate x by the relation:

$$\tau \approx \tau_1 = \sqrt{\frac{m}{2qU_0}}\cdot\frac{lV}{2dU_0}\cdot x \tag{5}$$

This difference in residence time inside the deflector results in a difference in arrival time with respect to the reference trajectory at any x-y plane at $z=z_f$ after the deflector. To evaluate the effect in the deflected beam the transition is made to the primed coordinate system. With the approximations $\alpha(x)=\alpha_0$ i.e. $x'(x)=x$, and $v_z(x)=v_0=v_zU_0$) the difference in the time of arrival is transformed into a spatial shift $\zeta_1$ of isochronous points in negative z'-direction.

$$\zeta_1(x') = \tau_1\cdot v_0 = \tau_1\cdot\sqrt{\frac{2qU_0}{m}} \tag{6}$$

Figure 2:
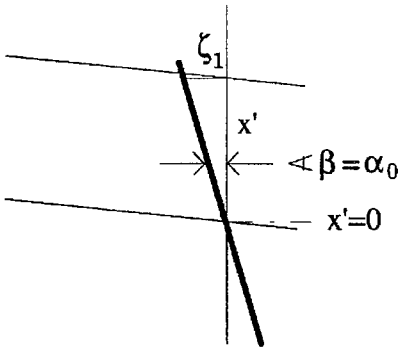
FIG. 2 shows the isochronous plane of the ions tilted by angle $\beta=\alpha_0$.

The first order the time shift $\tau_1$ is a linear function of x or x'. In space, the isochronous surface $\zeta_1(x')$ is a plane tilted by an angle $\beta$ with respect to the x'-y' (parallel to the x-y) plane (FIG. 2):

$$\beta = \frac{\zeta_1(x')}{x'} \tag{7}$$

Inserting (5) and (6) into Equation (7) and comparing with the equation for the deflection angle $\alpha_0$ (Equ. 2) reveals that:

$$\beta = \frac{lV}{2dU_0} = \alpha_0 \tag{8}$$

Equation (8) contains the primary discovery underlying the invention: A package of ions 21 that is isochronous in the x-y plane entering an electrostatic deflector along the z-axis and that is deflected by a certain small angle in the x-z plane is tilted in space with respect to the x-y plane by that same angle but in the opposite sense of rotation (FIG. 3*a*).

Figure 3:
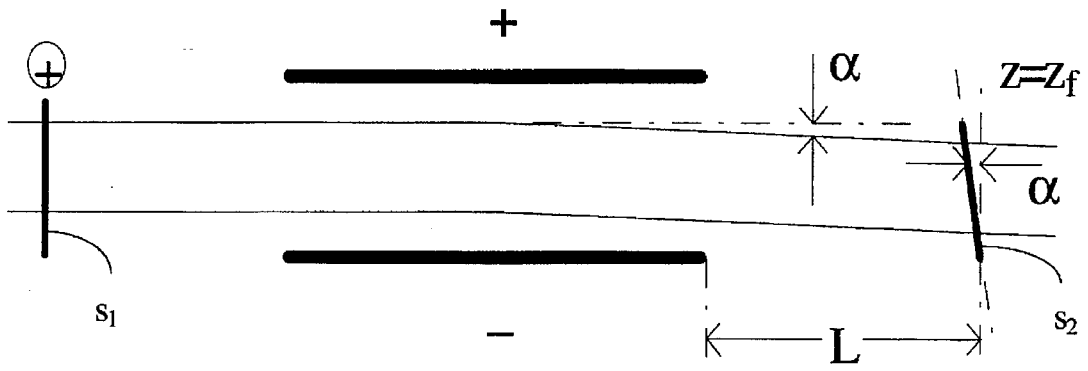
FIG. 3A and 3B show the first order tilting of the isochronous surface by an electrostatic deflector.
Figure 3:
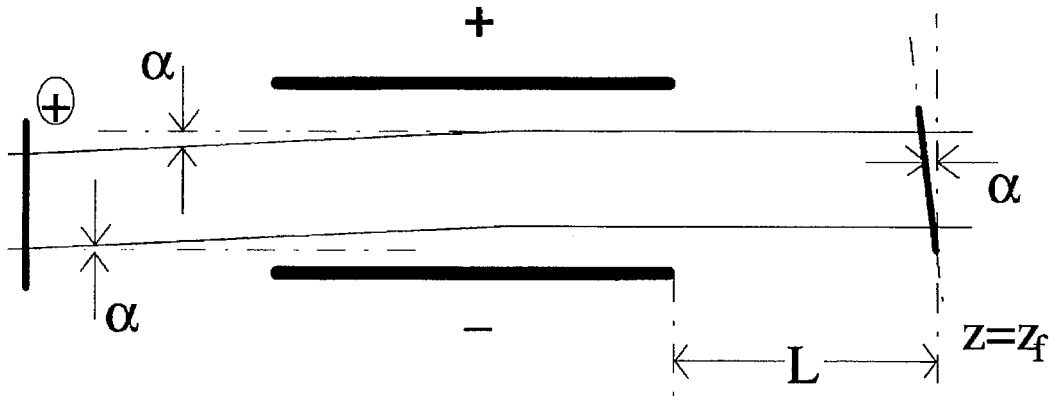

Symmetry considerations show that a beam entering the deflector under an angle and leaving it along the axis undergoes the same tilting of the isochronous surface (FIG. 3*b*). In general any deflection ofmonoenergetic ion packages is accompanied by a tilting of the isochronous surface in the plane of deflection by the deflection angle and in the direction opposite to the direction of deflection. The result can, in principle, be applied to monoenergetic ion packages independent of the initial shape of the isoehronous surface prior to deflection, as any additional distortion is preserved. Hence, multiple deflections can be superimposed, leading to a compound angle inclination of the isochronous surface.

Alignment of the Detector Surface

The mass resolution of a time-of-flight spectrometer is defined as $R=M/\Delta M=T/2\Delta T=L_{cq}/2w$, where M is the ion mass to charge ratio, $\Delta M$ the full width at half maximum (FWHM) of the corresponding monoisotopic mass peak, T the mean total flight time of these ions, $\Delta T$ the arrival time distribution (FWHM), $L_{cq}=T/v_0$ the equivalent length of the flight path, and w the apparent width of the ion package upon arrival at the detector surface.

In a conventional TOF-MS, the detector surface is mounted perpendicular to the axis of the instrument, i.e. it lies in the x'-y' plane. Let $w_0$ be the width of the undeflected package in z'-direction and b its width in the x-direction determined either by beam limiting apertures or by the open width of the detector itself. Then, the apparent width of the package as it is seen by the detector surface is;

$$w=w_0+w_1;\ w_1=b\cdot\alpha_0 \tag{9}$$

Depending on the magnitudes of both b and $\alpha_0$ the mass resolution can be considerably diminished. As an example, for a deflection angle of 3 degrees, $\alpha_0=0.0524$ rad, and for typical instrument parameters $w_0=0.5$ mm, b=20 mm, the mass resolution $R=L_{cq}/2w$ achieved would be only one third of the optimum value $R_0=L_{cq}/2w_0$.

More generally, with the isochronous ion surface inclined by an angle $\alpha$ and the detector surface inclined by an angle $\gamma$ with respect to the x'-y' plane the apparent broadening of the ion package $w_1$ is given by the relation;

$$w_1=b\cdot(\alpha-\gamma) \tag{10}$$

Its contribution to the apparent width w (Eq. 9) vanishes if the two surfaces become aligned, i.e. $\alpha-\gamma=0$. Only then, the package width w that is seen by the detector surface is minimized and equal to $w_0$.

The invention therefore states that, in order to achieve the optimum mass resolution in a linear TOF-MS instrument that uses electrostatic deflectors, the detector surface has to be tilted with respect to the instrument axis in the plane of deflection by an angle equal to the angle of deflection but in the opposite sense of rotation.

Misalignment between the isochronous ion package surface and the detector surface may also be caused by mechanical tolerances of the vacuum chambers or mounting fixtures, by the bending of chambers or flanges when under the force of outside atmospheric pressure or by other mechanical distortions. It is known in the field of TOF-MS that in order to correct the alignment of the two planes and optimize the performance of a TOF-MS instrument, adjustable detector mounts may be used. It is the new feature of this invention to relate the bias angle of the detector surface directly to the angle of deflection in an instrument that employs electrostatic deflectors.

Linear TOF-MS with Orthogonal Injection of Externally Generated Ions

A linear TOF-MS is shown schematically in FIG. 4, comprising an ion accelerator with two stages 26 and 27, a drift space 28, and an ion detector 40 with detector surface 34. The first stage accelerator 26 is formed by repeller electrodes 21 and 22 and the second stage accelerator 27 is formed by the electrodes 22 and 23. These electrodes are essentially flat and mounted parallel to each other and perpendicular to the instrument axis 24. Central openings in electrodes 22 and 23 are covered with meshes 29 and 30 to assure homogenous electric fields in spaces 26 and 27 when electrical potentials are applied to electrodes 21, 22, and 23. It is taught in U.S. Pat. No. 2,685,035 (Wiley) and in Wiley et at., that if suitable electric potentials are applied to electrodes 21, 22, 23, a spatial distribution of ions 32 in space 26 with axial width w is expelled from that space and accelerated towards the detector 40 in such a way that the longitudinal distribution in flight direction is compressed to a thin sheet of ions 33 with width w' in front of the detector 40. This effect is called space focusing or longitudinal focusing.

Other variants of a linear TOF-MS may comprise additional electrodes, shields, apertures, etc., to suffice for specific needs.

In one aspect of the invention, which is shown as preferred embodiment in FIG. 4, a continuous beam of ions 41 is at first generated externally to the actual TOF-MS by means of an ion source 10 and accelerating, focusing, and steering electrodes, which comprise an ion transfer system 20. This transfer system may guide the ions through one or more stages of differential pumping and may include means to effectively assimilate the motion of all ions in said beam, preferentially in a high pressure radio-frequency-ion-guide.

When exiting from the transfer system 20 said ions 41 shall have a mean kinetic energy $qU_i$, where q is the ion charge and $U_i$ is a total accelerating electrical potential difference. This initial beam of ions is directed into the gap 26 between the first two electrodes 21 and 22 of the ion accelerator of the linear TOF-MS. It was found to be advantageous (O'Halloran et al.), if the injection is done in such a way that the direction of motion of the initial ion beam 41 is parallel to the accelerator electrodes 21 and 22, hence orthogonal to the instrument axis 24.

Ions are admitted into the space between electrodes 21 and 22, while those are held at a common electrical potential equal to the electric potential of the last electrode used to form the initial ion beam, which in turn is preferentially held at ground potential.

Then, electric potentials are applied to one or both of said accelerator electrodes 21 and 22 by means of external power supplies and suitable switches. This generates an electric field between these electrodes, which accelerates the ions in space 26. The direction of this accelerating field is orthogonal to the direction of the initial ion beam 41 and is established in such a way that the ions in that space begin to move towards the ion detector 40. At the same time, this field effectively blocks ions of the initial beam from entering into said space.

In one variant of the preferred embodiment, first stage accelerator 26 may be effectively divided by an additional electrode, the purpose of that electrode being to shield the space where the ions from the initial beam enter the accelerator from the electrical field which penetrates into space 26 from space 27 through the mesh 29. In another variant, additional electrodes held at electrical potentials intermediate to the potentials applied to either electrodes 21 and 22 or 22 and 23, and proportional to their distance from those electrodes, may be used to extend the length of each accelerator stage.

After the ions have left the accelerator region 26, the electrical potentials applied to the accelerator electrodes 21 and 22 can be reset to their original values, so that new ions from the initial beam 41 can enter into the space between them and a new cycle may begin.

After passing through the accelerating stages 26 and 27 of the TOF-MS, the ions reach the field free drift space 28. Due to the initial perpendicular motion, the drift direction is oblique to the axis of the accelerator fields and the instrument axis 24. The magnitude of the obliqueness depends only on the relative energies of the ions when they enter the region 26 and the field free drift region 28.

Let $qU_i$ be the kinetic energy of the ions orthogonal to the axis 24 of the TOF-MS instrument and $U_0$ be the total electrical potential difference that accelerates the ions towards the detector 40. Without steering, the angle of the ion trajectories with respect to the axis of the instrument in the field free drift region 28 is given by the ratio of the velocities:

$$\phi = \frac{v_i}{v_0} = \sqrt{\frac{U_i}{U_0}} \tag{11}$$

With typical parameters, the drift angle $\phi$ is of the order of several degrees.

In order to steer the ions in a direction which is parallel to the instrument axis, an electrostatic deflector with plate electrodes 11 and 12 and entrance and exit apertures 14 is employed in the preferred embodiment. The electrostatic deflector thus serves as a steering lens for steering the ion beam. The gap between the plates 11 and 12 is chosen but not restricted to be at least twice as wide as the width of the ion beam, and the length of the plates is chosen to be at least twice as long as the gap. The width of the plates is chosen accordingly to the width of the ion beam in that direction, but at least 1.5 times the width of the gap.

In the preferred embodiment of FIG. 4, the angle of deflection is made equal but opposite to the drift angle, $\alpha_0 = -\phi$ by adjusting the electrical potential difference between the deflector plates 11 and 12. As a result, the ions will drift parallel to the instrument axis 24 when leaving the deflector and reach the ion detector 40 at the end of the drift space 28.

As a further result of the deflection, as it is taught by the invention, the isochronous surface of an ion packet is tilted. This is shown in FIG. 3B and is indicated in FIG. 4 by isochronous surfaces $s_1$ and $s_2$. Hence, according to the invention, it is required that the ion detector surface 34 is tilted with respect to a plane perpendicular to the instrument axis 24, the tilt angle lying in the plane of deflection and being equal to the angle of deflection but in the opposite sense of rotation. From Equation (11) the initial drift angle can be calculated. Hence the required deflection angle is known, as well as the mounting angle of the detector surface and the voltage required to achieve such a deflection for a given deflector geometry.

In order to accomplish the tilt of the detector surface 34, in the preferred embodiment, the alignment of said detector surface is preset by means of an angular spacer or fixture 35. In addition, the mounting of the detector is made adjustable by means of one or two adjusters 36, adjusting the tilting in the plane of deflection, and the inclination in the perpendicular plane.

Preferentially, the adjusters 36 are made in such a way as to allow one to align the surface of the detector while operating the TOF-MS.

In another variant of the preferred embodiment, the predetermined tilt angle is preset by means of the adjuster or adjusters 36 according to the relations which specify the tilt angle of the isochronous surface of the ion packages.

Reflector TOF-MS with Parallel Reflector and Accelerator Electrodes

The V-shaped geometry of a Reflector-TOF-MS is schematically shown in FIG. 5, the embodiment comprising a single stage accelerator formed by electrodes 51 and 52, a deflector 53, an ion reflector 54 with homogeneous fields, the reflector having one or more stages, and a detector with detector surface 55.

According to the invention, it is now known that the isochronous surface is tilted by the angle of deflection which is indicated in the FIG. 5 by isochronous surfaces $s_1$, and $s_2$. By following the trajectories 56 and 57 from surfaces $s_2$ to $s_3$ through the reflection of the ion package it becomes evident that the angle of inclination with respect to the plane normal to the reflector axis 58 changes its sign.

Hence, it follows as essential part of the invention in this preferred embodiment, that the detector surface 55 must be inclined with respect to the instrument axis 24 in the plane of deflection, by the angle of deflection and in the direction of rotation of the deflection.

As before, this angle may be preset by angular spacers, or preset by adjusters, and may be adjustable around that preset value. Furthermore, by means of multiple, preferentially mutually orthogonal deflectors, a multiple deflection may be facilitated, which, according to the invention, will require a compound angle of the detector surface.

Reflector TOF-MS with Inclined Reflector Axis

It was proven that it is unfavorable for the resolution of a Reflector-TOF-MS if the surface of the in-going and outgoing ion package is not aligned parallel with the equipotential or electrode surface of the ion reflector (Karataev et al.).

Therefore, it is advantageous to employ a setup according to the embodiment of the invention which is shown schematically in FIG. 6. It includes the same accelerator, deflector, and reflector as FIG. 5, the deflection angle being $\alpha_0$. In this variant, the reflector axis 59 is inclined with respect to the instrument axis 24, the inclination being in the plane of deflection, and by the angle of deflection.

In this way, the reflector surface 61 becomes parallel with the isochronous surface $s_2$ of the ion packages, which themselves are tilted due to the deflection by the electrostatic deflector 53. After reflection, the isochronous surface $s_3$ remains parallel to the reflector surface 61, indicated by parallel planes $p_1$, $P_2$, $p_3$, and $p_4$.

To minimize the width of the ion package which is seen by the detector surface 65, it is furthermore part of this embodiment of the invention, that the detector surface 65 is mounted parallel to the reflector surface 61, by the means as they were already described above.

Second Order Approximation of the Residence Time Inside the Deflector

Taylor expansion of Equation (1) to second order in the small quantity $Vx/U_0d$ leads to the equation:

$$\tau \approx \tau_1 + \tau_2 \tag{12}$$

-continued $$\tau_2 = \frac{l}{\sqrt{\frac{2qU_0}{m}}} \cdot \left[ \frac{3}{8} \cdot \left( \frac{V}{d \cdot U_0} \right)^2 \cdot x^2 \right] = \frac{1}{v_0} \cdot \frac{3}{2 \cdot l} \cdot \alpha_0^2 \cdot x^2$$

where $\tau_1$ is the first order shift in time as calculated above (Equ. 4) and $\tau_2$ is the second order shift; $\tau_2$ gives only positive contributions; ions with $x \neq 0$ arrive later than is expected from the first order approximation. In space, the isochronous surface is curved:

$$\zeta(x') \approx \zeta_1 + \zeta_2 = \alpha_0 \cdot x' + \frac{3}{2 \cdot l} \cdot \alpha_0^2 \cdot x'^2 \tag{13}$$

With the beam density being constant in the x-y plane, the second order contribution $w_2$ to the apparent width is found to be at the most:

$$w_2 = \frac{3}{2 \cdot l} \cdot \alpha_0^2 \cdot \left( \frac{b}{2} \right)^2 \tag{14}$$

For small detectors (i.e. small b), $w_2$ is small. With big area detectors, however, $w_2$ limits the mass resolution of a TOF instrument. In this case, the inverse dependency of $w_2$ from the plate length l indicates that it is advantageous to utilize rather long deflectors.

Axial Energy Changes Induced by Deflection

Due to action of the perpendicular field inside the deflectors, ions do not leave at the same x-position as they enter but at a position slightly shifted in the direction of the deflection by the small quantity s=s(x) as can be seen in FIG. 1A. Upon leaving the deflectors they are therefore not regaining the initial energy $U_0$ but the energy $U_{out}$ that is slightly smaller than $U_0$.

$$U_{out} = U_0 - \frac{V}{d} \cdot s \tag{15}$$

s=s(x) is easily found from the equation of motion inside the deflectors:

$$s(x) = \alpha_0 \cdot \frac{1}{2} \cdot \left( \frac{1}{1 - \frac{Vx}{U_0 \cdot d}} \right) = \alpha_0 \cdot \frac{1}{2} \cdot \left( 1 + \frac{Vx}{U_0 \cdot d} + \ldots \right) \tag{16}$$

As s=s(x) depends on the entry position, this shift introduces a distribution of axial energies. As a result, the ions travel with different velocities and the arrival time distribution at the detector (i.e. the longitudinal focus plane) at a distance L from the deflector exit will be affected. It can be shown that the additional shifts ofisochronous points are given by the relation:

$$\zeta_3(x') \approx \frac{L}{l} \cdot \alpha_0^3 \cdot x' \tag{17}$$

This is only of third order in $\alpha_0$ but depends in first order on L/l suggesting again that rather long deflectors should be used whenever a long flight tube is required. The effect as approximated is also linear in the coordinate x' and therefore leads to a small additional tilt of the isochronous surface. Its impact upon mass resolution can in principle be made to vanish in the same way as the first order effect discussed above as long as the total tilt angle is small.

Axial Energy Distribution

So far, only monoenergetic ion beams or ion packages with initial kinetic energy $qU=qU_0$ in z-direction were considered. A distribution of energies $qU=q(1+\delta)U_0$ around $qU_0$ with $|\delta|<<1$, $\delta=(U-U_0)/U_0$ will result in a distribution of deflection angles around the angle $\alpha_0$. For small angles, one finds for the angular dispersion from Equation (2):

$$\partial\alpha=\alpha-\alpha_0=-\delta\cdot\alpha_0 \tag{18}$$

In TOF-MS, by means of accelerator configurations like the Wiley/McLaren two stage TOF-accelerator, ions have different energies due to different starting points in the accelerator, but are brought to a longitudinal focus at a plane $z=z_f$. At this plane of interest, at a distance L from the deflector an ion with energy $U=U_0$ arrives at point X (FIG. 7), whereas an ion with energy $U=(1+\delta)U_0$ will arrive at a different point X' in the same plane $z=z_f$. Ions with energy $U_0$ are deflected by an angle $\alpha_0$ and form the isochronous plane P inclined by the angle $\alpha_0$ according to the first order result. Ions with energy $U=(1+\delta)U_0$ are deflected by $\alpha_0+\partial\alpha$ and form a plane P' separated from plane P; note that $\partial\alpha$ is negative when $\delta$ is positive; also, P' would be inclined by the angle $\alpha_0+\partial\alpha\approx\alpha_0$ as is obvious from Equations (1), (2) and (8). The angular dispersion causes a broadening of the ion package in z'-direction to the width $w_4$. With the total relative energy given by: $((U_{max}-U_{min})/U_0)=\bar{\delta}$ it is found that $$w_4\approx L\cdot\partial\alpha\cdot\alpha_0=\bar{\delta}\cdot L\cdot\alpha_0^2 \tag{19}$$

This broadening is of second order in the angle $\alpha_0$ and of first order in the relative energy spread $\bar{\delta}$, which is also a small quantity. However, as L increases, the effect will limit the achievable mass resolution.

Distribution of Injection Energies Orthogonal to the Flight Axis

The effect of an energy spread of the orthogonally injected beam 41 upon the arrival time at the location of the time focus $z=z_f$ can be evaluated as follows. First, assume all ions experience the same deflection $\alpha_0$ and they all travel with energy $qU_0$ in the z direction (see FIG. 8). The higher orders in residence time and final energy were already considered separately above. The central ion trajectory with $qU_i=qU_{i0}$ will start at the point $X_0$ $(x_0, 0,0)$ and arrive at the point $F=(0,0, z_f)$. Any ion with $qU_{i1}<qU_{i0}$ will initially travel under the angle $\alpha_1<\alpha_0$ and will leave the deflector at an angle $\alpha_1-\alpha_0<0$. In order to arrive at F, this ion would have to start at a different location $X_1$ $(x_1,0,0)$ with $x_1>x_0$. Inside the deflector this ion follows a trajectory that is more in the "slower" section. Similarly, an ion with initial orthogonal energy $qU_{i2}>qU_{i0}$ will travel through the deflector in the "faster" section.

Given the distance L and the difference in exit angle $\alpha_i-\alpha_0$ the coordinate x of the trajectory inside is found; then, by using the first order result for the residence time, the arrival time difference is readily evaluated. Consider the inverted problem: Trajectories leave point F with $U_z=U_0$ towards the deflector under an angle $\gamma$ with respect to the symmetry plane (z-y plane). One finds for $\gamma$:

$$\gamma=\alpha_0-\alpha_i=\sqrt{\frac{U_{i,0}}{U_{z,0}}}-\sqrt{\frac{U_i}{U_{z,0}}} \tag{20}$$

The orthogonal injection energy can be written as:

$$qU_i=q\cdot(1+\epsilon)\cdot U_{i,0} \tag{21}$$

Then, inserting (21) into (20)

$$\gamma=\alpha_0\cdot(1-\sqrt{1+\epsilon}) \tag{22}$$

Under the assumption of small angles the deflector entry position in the inverted problem is now found easily:

$$x=L\cdot\gamma=L\cdot\alpha_0(1-\sqrt{1+\epsilon}) \tag{23}$$

For the difference of residence times inside the deflector between an ion that enters at $x\neq0$ compared to the reference ion with $x=0$ one has from the first order relation:

$$\tau=T(x)-T(0)\approx\frac{1}{v_0}\cdot\left[\frac{1}{2}\cdot\frac{V}{U_0d}\right]\cdot x \tag{24}$$

$v_0=v_z(U_0)$ is the velocity of an ion of energy $qU_0$ in the z-direction. Collecting terms, the total difference in flight time between an ion with orthogonal energy $qU_i$ and the reference trajectory with $U_i=U_{i0}$ is found as a function of the parameter $\epsilon$:

$$\tau=\frac{1}{v_0}\cdot\alpha_0^2\cdot L\cdot(1-\sqrt{1+\epsilon}) \tag{25}$$

With $|\epsilon|<<1$ this can be approximated by expansion of the square root:

$$\tau=\frac{1}{v_0}\cdot\alpha_0^2\cdot L\cdot\left[\left(-\frac{1}{2}\right)\cdot\epsilon+\ldots\right] \tag{26}$$

The total relative energy spread is given as $((U_{i,max}-U_{i,min})/U_{i,0})=\epsilon_{max}-\epsilon_{min}=\bar{\epsilon}$. Consequently, one has for the total flight time distribution from the orthogonal injection input line to the point F:

$$\Delta\tau=|\tau(\epsilon_{max})-\tau(\epsilon_{min})|=\frac{1}{2v_0}\cdot\alpha_0^2\cdot L\cdot\bar{\epsilon} \tag{27}$$

This is evidently equivalent with the arrival time distribution at point F for ions starting at the same time along the input line. This spread of arrival times at the point F corresponds to a broadening of the ion package:

$$w_5=\Delta\tau\cdot v_0=\frac{1}{2}\cdot\bar{\epsilon}\cdot L\cdot\alpha_0^2 \tag{28}$$

The effect is found to be of second order in $\alpha_0$ and small only if the product $L\cdot\bar{\epsilon}$ is much smaller than $1/\alpha_0$. It follows that in order to achieve best mass resolution results it is necessary to control the relative distribution of orthogonal injection energies. Hence, it is advantageous, according to the invention, to include means into the ion transfer system 20 between the ion source 10 and the TOF-MS (FIG. 4) that effectively normalizes or homogenizes the relative motions of the ions.

Deflectors and Focusing Elements

Electrostatic lenses are used to focus the ions on the detector of the TOF-MS in order to improve the sensitivity of the instrument. In a focused beam, a trajectory that starts with the coordinate x will be at a distance $x'=\lambda\cdot x$ with $\lambda<1$ from the reference trajectory at the plane $z=z_f$. If the focusing lens does not introduce any additional time shifts then $\zeta_1$ will be unchanged. Hence, the angle of inclination of the isochronous plane will be increased:

$$\beta'=\frac{\zeta_1}{x'}=\frac{1}{\lambda}\cdot\beta \tag{29}$$

Focusing of the beam to half the original size in the x-direction will double the tangent of the inclination angle of the isochronous surface. For stronger focusing, i.e. $\lambda<<1$, $\beta^6$ becomes impractically large. Obviously this strong effect limits the use of deflectors in combination with focusing elements. For moderate $\lambda$, however, the correction by tilting the detector surface at the appropriate angle can be applied.

Although the invention has been described in terms of specific preferred embodiments, it will be obvious and understood to one of ordinary skill in the art that various modifications and substitutions are contemplated by the invention disclosed herein and that all such modifications and substitutions are included within the scope of the invention as defined in the appended claims.

References Cited

The following references are referred to above, the disclosures of which are hereby incorporated herein by reference:

U.S. Patent Documents

| | | |
|---|---|---|
| 2,685,035 | July 27, 1954 | Wiley |
| 4,072,862 | Feb. 7, 1978 | Mamyrin et al. |

Foreign Patent Documents

| | | |
|---|---|---|
| 198,034 | Soviet Union | (Mamyrin Russian Patent, filed 1966) |

Other Publications

W. C. Wiley, I. H. McLaren, Rev. Sci. Inst. 26, 1150 (1955)

G. J. O'Halloran, R. A. Fluegge, J. F. Betts, W. L. Everett, Report No. ASD-TDR 62-644, Prepared under Contract AF 33(616)-8374 by The Bendix Corporation Research Laboratories Division, Southfield, Mich. (1964)

J. H. J. Dawson, M. Guilhaus, Rapid Commun. Mass Spectrom. 3, 155 (1989)

A. F. Dodonov, I. V. Chemushevich, V. V. Laiko, 12$^{th}$ Int. Mass Spectr. Conference, Amsterdam (1991);

O. A. Migorodskaya, A. A. Shevchenko, I. V. Chemushevich, A. F. Dodonov, A. I. Miroshnikov, Anal. Chem. 66, 99 (1994)

A. N. Verentchikov, W. Ens, K. G. Standing, Anal. Chem. 66, 126 (1994)

R. F. Herzog, Z. Phys. 89 (1934), 97 (1935); Z. Naturforsch 8a, 191 (1953), 10a, 887 (1955)

V. I. Karataev, B. A. Mamyrin, D. V. Shmikk, Soy. Phys. Tech. Phys. 16, 1177 (1972);

B. A. Mamyrin, V. I. Karataev, D. V. Shmikk, V. A. Zagulin, Soy. Phys. JETP 37, 45 (1973)

What is claimed is:

1. An apparatus for separation of ionic species using a time-of-flight mass analyzer, comprising:

a time of flight mass analyzer having a time of flight tube, said time of flight tube defining an axis;

an ion beam steering lens having a homogeneous electrostatic field which is directed predominantly sideways to said axis, said steering lens deflecting ion packets passing through said steering lens, said ion packets being deflected at an angle of deflection, and forming a plane; and an ion detector placed at the end of a flight tube analyzer region for detection of said ion packets, said detector having a detector surface wherein said detector surface is tilted by an angle equal to said angle of deflection of said ion packets, said detector surface being parallel to said plane of said ion packets.

2. An apparatus according to claim 1, further comprising a tilting mechanism to adjust and achieve the angle on said detector surface matching said angle of deflection of said ion packets.

3. An apparatus according to claim 1, wherein said analyzer contains multiple homogeneous electrostatic deflection fields.

4. An apparatus according to claim 3, wherein said homogeneous deflection fields are generated by means of a pair of parallel plate electrodes.

5. An apparatus according to claim 3, wherein said homogeneous deflection fields are generated by means of sets of electrodes.

6. An apparatus according to claim 1, wherein the inclination of said detector surface is biased according to the angle of deflection, but is adjustable around that angle.

7. An apparatus according to claim 1, wherein the ions are generated externally to said analyzer and injected by means of electrical acceleration into said analyzer orthogonal to the direction of said homogeneous electrostatic fields.

8. An apparatus according to claim 7, wherein the relative motion of the ions prior to injection is homogenized by means of a high pressure multipole radio-frequency ion guide.

9. An apparatus for separation of ionic species using a reflection-time-of-flight mass analyzer comprising:

at least one of ion beam steering electrostatic reflectors having at least one of homogenous reflecting fields, said at least one of ion beam steering electrostatic reflectors defining a longitudinal axis;

an ion beam steering lens having a homogeneous electrostatic field, which is directed predominantly sideways to the axis of the analyzer said steering lens deflecting ions at an angle;

said steering lens having entry and exit aperture plates to reduce the fringing fields felt by the ions;

a means for an ion detector placed after the reflectors at the end of a flight tube analyzer region, said ion detector having a surface, where the surface of the detector is tilted with respect to the plane perpendicular to said axis of the reflectors by an angle equal to said angle of deflections of said ions;

a means for a tilting mechanism to adjust and achieve the angle on the detector surface matching the angle deflected by the steering lens;

said tilting mechanism being hermetically sealed to have the means for adjustment from outside a vacuum enclosure.

10. An apparatus according to claim 9, wherein said longitudinal axis of said reflector is tilted in the plane of deflection by said angle of deflection and in the direction parallel to the longitudinal direction of said ion detector, and wherein said detector surface is perpendicular to said longitudinal axis of said reflector.

11. An apparatus according to claim 9, wherein the inclination of said detector surface is biased according to said angle of deflection, but is adjustable around said angle of deflection.

12. An apparatus according to claim 9, wherein the ions are generated eternally to said analyzer and injected by means of electrical acceleration into said analyzer orthogonal to the direction of said homogeneous electrostatic field.

13. An apparatus according to claim 12, wherein the relative motion of the ions prior to injection is homogenized by means of a high pressure multipole radio-frequency ion guide.

* * * * *